US009887458B2

(12) United States Patent
Legay et al.

(10) Patent No.: US 9,887,458 B2
(45) Date of Patent: Feb. 6, 2018

(54) COMPACT BUTLER MATRIX, PLANAR TWO-DIMENSIONAL BEAM-FORMER AND PLANAR ANTENNA COMPRISING SUCH A BUTLER MATRIX

(71) Applicants: THALES, Courbevoie (FR); UNIVERSITE DE RENNES 1, Rennes (FR); CENTRE NATIONAL DE LA RECHERCHE SCIENTIFIQUE, Paris (FR)

(72) Inventors: Hervé Legay, Plaisance du Touch (FR); Jean-Philippe Fraysse, Toulouse (FR); Etienne Girard, Plaisance du Touch (FR); Mauro Ettorre, Rennes (FR); Ronan Sauleau, Acigne (FR)

(73) Assignees: THALES, Courbevoie (FR); UNIVERSITE DE RENNES 1, Rennes (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 87 days.

(21) Appl. No.: 15/076,244

(22) Filed: Mar. 21, 2016

(65) Prior Publication Data

US 2016/0285165 A1 Sep. 29, 2016

(30) Foreign Application Priority Data

Mar. 23, 2015 (FR) ..... 15 00565

(51) Int. Cl.
*H01Q 3/40* (2006.01)
*H01Q 21/06* (2006.01)
(Continued)

(52) U.S. Cl.
CPC ..... *H01Q 3/40* (2013.01); *H01P 1/182* (2013.01); *H01P 3/121* (2013.01); *H01P 5/024* (2013.01);
(Continued)

(58) Field of Classification Search
CPC ..... H01Q 3/40; H01Q 21/061
(Continued)

(56) References Cited

U.S. PATENT DOCUMENTS 3,170,158 A 2/1965 Walter
5,812,089 A 9/1998 Locke
(Continued)

FOREIGN PATENT DOCUMENTS

FR 2 944 153 A1 10/2010
FR 2 986 377 A1 8/2013
JP 2004-266521 A 9/2004

OTHER PUBLICATIONS

Cheng et al., "Miniaturized Multilayer Folded Substrate Integrated Waveguide Butler Matrix," Progress in Electromagnetics Research, vol. 21, Apr. 12, 2011, pp. 45-58, XP055238662.
(Continued)

*Primary Examiner* — Dean Takaoka
(74) *Attorney, Agent, or Firm* — Baker & Hostetler LLP

(57) ABSTRACT

A compact Butler matrix consists a planar multilayer structure comprising N parallel metal plate waveguides PPW, stacked one on top of the other, two adjacent waveguides PPW comprising a common wall consisting of one of the metal plates. The couplers, the phase-shifters and the cross-over devices of the Butler matrix consist of metasurfaces incorporated in the metal plates. The planar two-dimensional beam-former can comprise a Butler matrix with waveguides PPW associated with optical lenses incorporated in each waveguide PPW. Alternatively, the planar
(Continued)

two-dimensional beam-former can comprise an upper stage consisting of a Butler matrix with waveguides PPW, and a lower stage comprising waveguides PPW equipped with incorporated reflectors, the two stages being connected in series.

15 Claims, 6 Drawing Sheets

(51) Int. Cl.

| | |
|---|---|
| ***H01Q 25/00*** | (2006.01) |
| ***H01P 3/12*** | (2006.01) |
| ***H01Q 1/28*** | (2006.01) |
| ***H01Q 15/00*** | (2006.01) |
| ***H01Q 15/08*** | (2006.01) |
| ***H01Q 15/10*** | (2006.01) |
| ***H01Q 15/16*** | (2006.01) |
| ***H01P 1/18*** | (2006.01) |
| ***H01P 5/02*** | (2006.01) |
| ***H01Q 21/00*** | (2006.01) |

(52) U.S. Cl.
CPC ..... *H01Q 1/288* (2013.01); *H01Q 15/008* (2013.01); *H01Q 15/0073* (2013.01); *H01Q 15/0086* (2013.01); *H01Q 15/08* (2013.01); *H01Q 15/10* (2013.01); *H01Q 15/16* (2013.01); *H01Q 21/0031* (2013.01); *H01Q 21/061* (2013.01); *H01Q 21/064* (2013.01); *H01Q 25/008* (2013.01)

(58) Field of Classification Search
USPC ..... 333/117, 122; 342/373
See application file for complete search history.

(56) References Cited

U.S. PATENT DOCUMENTS

| | | | | |
|---|---|---|---|---|
| 5,936,588 | A | 8/1999 | Rao et al. | |
| 6,377,558 | B1 * | 4/2002 | Dent | H01Q 3/40 342/354 |
| 6,980,169 | B2 * | 12/2005 | Honda | H01Q 15/04 343/775 |
| 6,995,730 | B2 * | 2/2006 | Pleva | G01S 7/032 343/853 |
| 8,577,308 | B2 * | 11/2013 | Choi | H04B 7/0617 455/101 |
| 2011/0148727 | A1 | 6/2011 | Chang et al. | |
| 2013/0076565 | A1 | 3/2013 | Lee et al. | |
| 2013/0181880 | A1 | 7/2013 | Shen et al. | |
| 2014/0320345 | A1 * | 10/2014 | Caille | H01Q 3/40 342/373 |
| 2014/0320346 | A1 * | 10/2014 | Caille | G02B 6/28 342/375 |

OTHER PUBLICATIONS

Remez et al., "Compact Designs of Waveguide Butler Matrices," IEEE Antennas and Wireless Propagation Letters, vol. 5, No. 1, Dec. 1, 2006, pp. 27-31, XP011148791.

Alessandri et al., "Rigorous and efficient fabrication-oriented CAD and optimization of complex waveguide networks," Microwave Symposium Digest, 1997, pp. 1013, XP032379882.

Rotman, "Wide-angle scanning with microwave double-layer pill-boxes," IRE Transactions on Antennas and Propagation, vol. 10, No. 1, Jan. 1, 1958, pp. 96-105, XP011220509.

Kaneda et al., "2D Beam Scanning Planar Antenna Array Using Composite Right/Left-Handed Leaky Wave Antennas," IEICE Transactions on Electronics, Institute of Electronics, vol. E89C, No. 12, Dec. 1, 2006, pp. 1904-1911, XP001541484.

* cited by examiner

COMPACT BUTLER MATRIX, PLANAR TWO-DIMENSIONAL BEAM-FORMER AND PLANAR ANTENNA COMPRISING SUCH A BUTLER MATRIX

CROSS-REFERENCE TO RELATED APPLICATION

This application claims priority to foreign French patent application No. FR 1500565, filed on Mar. 23, 2015, the disclosure of which is incorporated by reference in its entirety.

FIELD OF THE INVENTION

The present invention relates to a compact Butler matrix, a planar two-dimensional beam-former and a multiple-beam planar antenna comprising such a Butler matrix. It applies to any multiple-beam antenna, notably in the field of space applications such as satellite telecommunications, and more particularly to the antennas of small thickness.

BACKGROUND

The beam-formers are used in the multiple-beam antennas to generate output beams from input radiofrequency signals. A conventional beam-former comprises N inputs In1 to InN, P outputs Out1 to OutP, and a plurality of radiofrequency circuits 11, 12, 13 suitable for dividing and recombining the input radiofrequency signals according to a phase and amplitude law chosen to form output beams. There are various beam-former technologies. In FIG. 1, the radiofrequency circuits comprise a large number of individual waveguides 10 which cross over one another so as to allow combinations necessary for the formation of the various output beams by the radiofrequency signal combiners 12. These beam-formers are suitable for a limited number of radiating elements and for forming a limited number of beams because they become very complex when the number of beams increases because of the necessary crossovers between the waveguides.

It is also known practice to form beams by using a Butler matrix consisting of a symmetrical passive circuit with N input ports and N output ports, which drives the radiating elements producing N different beams of equal amplitudes. The circuit is made up of junctions which connect the input ports to the output ports by N different and mutually parallel transmission lines 18. There are a number of possible Butler matrix configurations. In the diagram of FIG. 2, the Butler matrix comprises couplers 15, of 3 dB, 90° hybrid coupler type, making it possible to combine or divide the power of the input radiofrequency waves, phase-shifters 16 suitable for applying a phase delay of 45°, and crossover devices 17 making it possible to cross over two different transmission lines. As is known, each crossover device 17 can consist of two 3 dB, 90° couplers connected in series. An example of Butler matrix architecture with four input ports A, B, C, D and four output ports A', B', C', D' is represented in FIG. 2. In this example, the Butler matrix comprises four 3 dB, 90° couplers, two 45° phase-shifters and a crossover device. This type of beam-former is well suited to the formation of a small number of beams but becomes too complex when the number of beams increases. Furthermore, it allows for the formation of the beams only in a single direction of space at right angles to the transmission lines 18.

According to another technology, there are planar quasi-optical beam-formers that use an electromagnetic propagation of the radiofrequency waves originating from a number of feeders placed at the input, for example feeder horns, according to a generally TEM mode of propagation between two parallel metal plates. The focusing and the collimation of the beams can be performed by an optical lens as described, for example, in the documents U.S. Pat. No. 3,170,158 and U.S. Pat. No. 5,936,588 which illustrate the case of a Rotman lens, or alternatively via a reflector as described for example in the documents FR 2944153 and FR 2 986377, the optical lens or, respectively, the reflector being inserted on the propagation path of the radiofrequency waves, between the two parallel metal plates. Different types of optical lenses can be used, these optical lenses serving essentially as phase correctors and making it possible, in most cases, to convert one or more cylindrical waves emitted by the feeds into one or more planar wave propagating in the parallel metal plate waveguide. The optical lens can comprise two opposing edges with parabolic profiles, respectively input and output. Alternatively, the optical lens can be a dielectric lens, a graded index lens with straight edges, or any other type of optical lens. In the case of a quasi-optical beam-former with optical lens, to obtain a planar antenna, it is sufficient to place input radiating elements around the input edge of the optical lens and to fix radiofrequency probes on the output edge of the optical lens, then to link each radiofrequency probe to an output radiating element via a transmission line, for example a coaxial cable. In the case of a pillbox beam-former, to obtain a planar antenna, input radiating elements are placed in front of the incorporated parabolic reflector, and output radiating elements are placed on the path of the radiofrequency waves reflected by the parabolic reflector. There are various pillbox beam-former solutions, using one or more reflectors.

Since this technology uses parallel plate waveguides, as an alternative to the use of a number of discrete radiating elements aligned side-by-side, it is possible to use a continuous linear aperture at the output of each parallel plate waveguide. These linear apertures, which are not spatially quantified, have performance levels very much superior to the linear networks of a number of radiating elements, for the beams that are misaligned, because of the absence of quantization, and in terms of bandwidth because of the absence of resonant propagation modes.

A quasi-optical beam-former is much simpler to produce than the traditional beam-formers with individual waveguides because it comprises neither coupler, nor crossover device. However, all the known planar beam-formers are capable of forming beams only in a single dimension of space, in a direction parallel to the plane of the metal plates. To form beams in two dimensions of space, in two directions, respectively parallel and orthogonal to the plane of the metal plates, it is necessary to orthogonally combine together two beam-forming assemblies, each beam-forming assembly consisting of a stacking of a number of unidirectional beam-forming layers. To orthogonally combine two beam-forming assemblies, it is further necessary to form connection interfaces, in particular input/output connectors, on each beam-forming assembly, then to link two-by-two, the various corresponding inputs and outputs of the two beam-forming assemblies by dedicated interconnecting cables as represented for example in the document U.S. Pat. No. 5,936,588 for lens-based beam-formers. This architecture is satisfactory for the formation of a small number of beams, but becomes very complex and excessively bulky when the number of beams increases.

To our knowledge, to date, there is no planar beam-forming device that makes it possible to form beams in two dimensions of space. Nor, moreover, are there any simple solutions for interconnecting two unidirectional beam-formers making it possible to dispense with the connection interfaces and interconnecting cables.

SUMMARY OF THE INVENTION

The aim of the invention is to remedy the drawbacks of the known beam-formers and to produce a planar two-dimensional beam-former comprising continuous transmission lines that make it possible to form beams in two dimensions of space without any connection interface or any interconnecting cable.

Another aim of the invention is to produce a novel Butler matrix that is particularly compact that has a novel parallel plate architecture compatible with the quasi-optical beam-formers.

For that, the invention relates to a compact Butler matrix comprising N waveguides, in which N is an integer number greater than three and chosen from the powers of two, couplers intended to couple two adjacent waveguides, phase-shifters and at least one crossover device suitable for crossing over two adjacent waveguides, the crossover device comprising two couplers connected in series. The Butler matrix consists of a planar multilayer structure comprising N+1 mutually parallel metal plates, stacked one on top of the other, and evenly spaced apart from one another, each space between two consecutive metal plates forming a parallel plate waveguide having two opposing walls, respectively top and bottom, consisting of the two consecutive metal plates, two adjacent metal plate waveguides comprising a common wall consisting of one of the metal plates, and the couplers, the phase-shifters and the crossover device consist of metasurfaces incorporated in the respective walls of the waveguides to be coupled, to be crossed over and to be phase-shifted.

Advantageously, the metasurfaces forming each coupler and the crossover device between two adjacent waveguides can consist of a metallized support provided with a plurality of through-holes evenly distributed in a coupling zone, respectively a crossover zone, of the wall common to the two corresponding adjacent waveguides, the crossover zone consisting of two coupling zones arranged cascaded one behind the other.

Advantageously, the metasurfaces forming each phase-shifter incorporated in a waveguide can consist of corrugations formed in a phase-shifting zone, on the two opposing walls of the corresponding waveguide.

Alternatively, according to a particular embodiment, each metal plate can consist of a metal coating deposited on a dielectric substrate and each coupler and crossover device between two adjacent waveguides can consist of a plurality of slits etched in the metal coating, the slits being evenly distributed throughout the coupling zone, respectively throughout the crossover zone, the crossover zone consisting of two coupling zones arranged cascaded one behind the other.

Alternatively, each phase-shifter can consist of a set of metal patches periodically photo-etched on the dielectric substrate of the two walls of a waveguide to be phase-shifted.

The invention relates also to a planar beam-former suitable for synthesizing beams in two dimensions of space, comprising at least one Butler matrix with N+1 parallel plates.

Advantageously, the beam-former can comprise two different Butler matrices stacked one on top of the other and respectively dedicated to two different mutually orthogonal polarizations.

According to an embodiment, the beam-former can further comprise N optical lenses respectively incorporated, at the output, or alternatively at the input, of the Butler matrix, in the N waveguides delimited by the N+1 metal plates.

Advantageously, each optical lens can be a lens of constant thickness and with graded index.

According to another embodiment, the beam-former can comprise two stacked stages, respectively lower and upper, each stage comprising an identical number of parallel plate waveguides, the Butler matrix being situated at the upper stage, each waveguide of the lower stage being connected in series to a waveguide of the upper stage by a respective intermediate parallel plate waveguide arranged orthogonally to the plane XOY of the two lower and upper stages, each intermediate waveguide forming a reflector incorporated in the beam-former.

The invention relates also to a planar antenna comprising at least one Butler matrix with N+1 parallel plates, the antenna further comprising M feeder horns connected at the input of each parallel metal plate waveguide, i.e. M.N feeder horns for the N metal plate waveguides, in which M is greater than 2, and N output feeder horns respectively connected to the N metal plate waveguides.

Advantageously, each output feeder horn can be a longitudinal horn coupled to a linear aperture extending transversely over the entire width of the corresponding parallel plate waveguide.

Advantageously, the liner apertures can be oriented in a direction at right angles to the plane of the parallel plates of the corresponding parallel plate waveguide.

BRIEF DESCRIPTION OF THE DRAWINGS

Other features and advantages of the invention will become clearly apparent from the rest of the description given by way of purely illustrative and nonlimiting example, with reference to the attached schematic drawings which represent.

DETAILED DESCRIPTION

Figure 1:
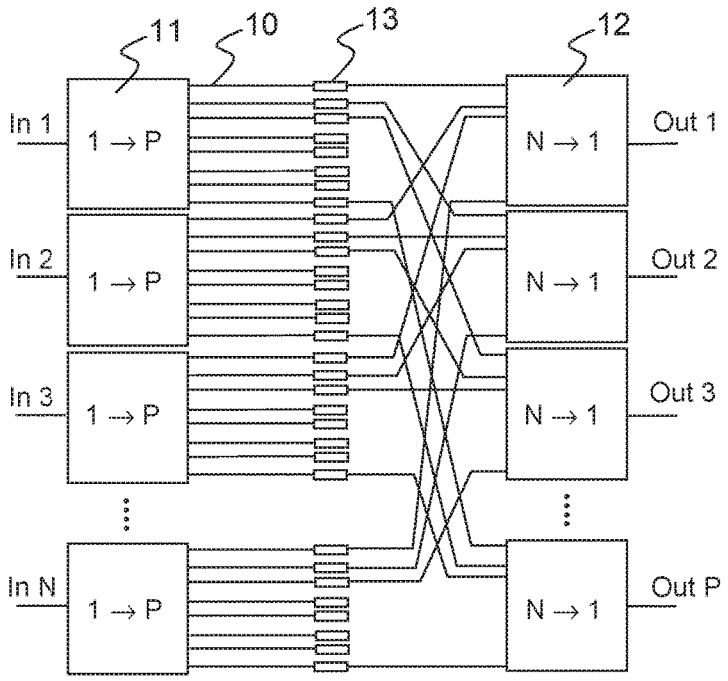
FIG.1 Prior Art
FIG. 1: a block diagram of an exemplary traditional beam-former, according to the prior art.
Figure 2:
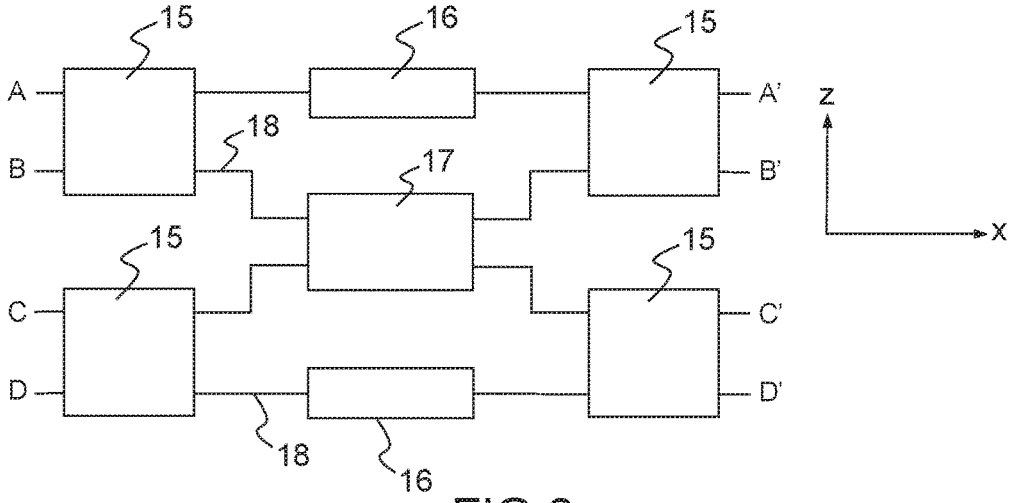
FIG.2 Prior Art
FIG. 2: an exemplary block diagram of a Butler matrix, according to the prior art.
Figure 3A:
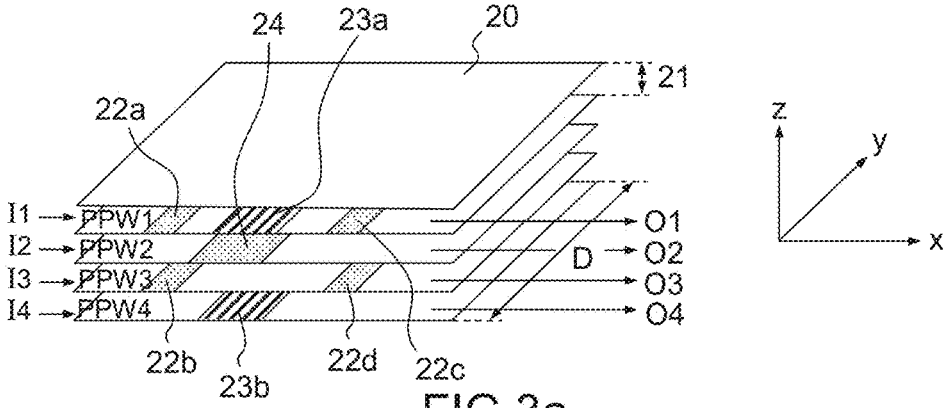
FIGS. 3*a* and 3*b*: two diagrams, respectively in perspective and in longitudinal cross section, of a first exemplary embodiment of a Butler matrix comprising a stacking of a number of parallel plate waveguides, according to the invention.
Figure 3B:
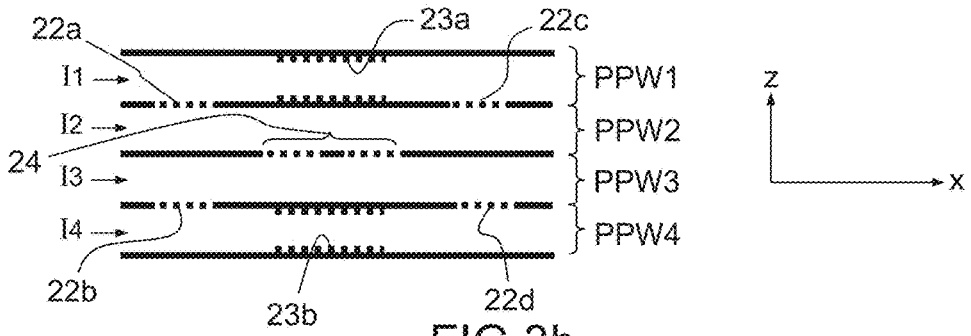

According to the invention, as represented in the diagrams of FIGS. 3*a* and 3*b*, the Butler matrix consists of a planar multilayer structure comprising N+1 mutually parallel metal plates 20, stacked one on top of the other, and evenly spaced apart from one another. The space 21 between two consecutive metal plates, consisting of air or of dielectric, forms a parallel plate waveguide PPW, the top and bottom walls of which are the two consecutive metal plates. In the various figures, the metal plates are parallel to the plane XOY, the direction X corresponding to the longitudinal direction of propagation of the radiofrequency waves in each parallel plate waveguide. Two adjacent waveguides PPW1 and PPW2, PPW2 and PPW3, PPW3 and PPW4, comprise a common wall consisting of one of the metal plates 20. The Butler matrix therefore comprises N parallel plate waveguides, stacked one on top of the other in the direction Z orthogonal to the plane XOY, in which N is an integer number greater than three and chosen from the powers of two. The Butler matrix also comprises couplers, for example of 3 dB, 90° hybrid coupler type, each coupler being intended to couple two adjacent waveguides together, 45° phase-shifters and crossover devices intended to mutually cross over two adjacent waveguides. According to the invention, the couplers 15, the crossover devices 17 and the phase-shifters 16 are incorporated locally in the metal plates forming the walls of the waveguides PPW1, PPW2, PPW3, PPW4 in respective coupling 22*a*, 22*b*, 22*c*, 22*d*, crossover 24 and phase-shifting 23*a*, 23*b* zones, situated on the propagation path of the radiofrequency waves and extending transversely, parallel to the direction Y, over the entire width D of the corresponding metal plate 20.

Figure 4A:
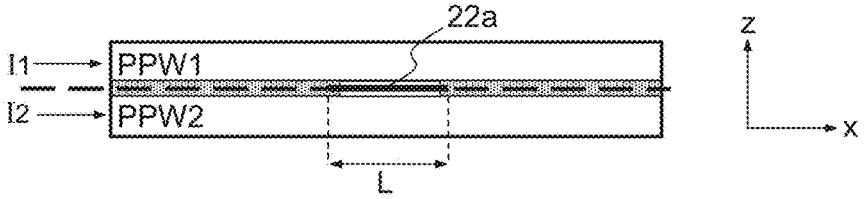
FIGS. 4*a* and 4*b*: two diagrams, respectively in longitudinal cross section and in plan view, illustrating an exemplary coupling zone inserted into a common metal plate between two metal plate waveguides according to the invention.
Figure 4B:
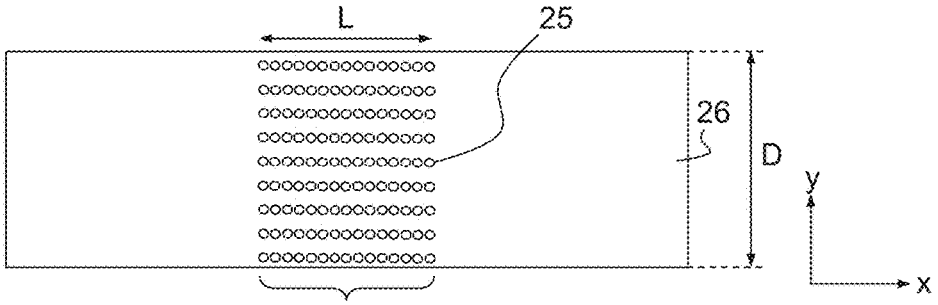

In order to mutually couple or cross over two adjacent waveguides, the metal plate forming the common wall between the two adjacent waveguides comprises coupling zones and crossover zones consisting of metasurfaces locally incorporated in said common wall. A metasurface is a textured surface consisting of a dense planar distribution of small elements, identical or not, fixed, or printed, or etched on a very thin support. A metasurface is characterized by a surface impedance which locally modifies the longitudinal propagation of a wave guided in a waveguide. A metasurface has properties that are very interesting from an electromagnetic point of view because it makes it possible to control the propagation of the electromagnetic waves along its surface. Depending on the properties sought, the fixed, printed or etched elements can for example be metal blocks or metal patches or holes, or slits, evenly distributed or of variable density, the distance between two consecutive elements being less than the central operating wavelength. As represented in FIGS. 4*a* and 4*b*, according to the invention, in each coupling zone 22*a*, 22*b*, 22*c*, 22*d* and in the crossover zone 24 which consists of two coupling zones arranged cascaded one behind the other, the metasurface consists of a metallized support 26 provided with a plurality of through-holes 25 evenly distributed throughout the coupling zone, respectively throughout the crossover zone. The distance separating two adjacent holes is very much less, by at least a factor of three, than the wavelengths guided in the parallel plate guide. The metasurface has a high reactive surface impedance, for example 100 Ohms, the value of which depends on the density of the holes and on the length L of the coupling zone. As a nonlimiting example, at 25 GHz, a 3dB, 90° coupler synthesized by a metasurface having a reactive surface impedance of 100 Ohms has been obtained with holes evenly distributed over a length L equal to 35 mm. Two identical metasurfaces placed end to end synthesize the crossover zone. It has been verified that these surface impedances are effective for radiofrequency waves having different angles of incidence.

To produce a phase shift in a parallel plate waveguide, PPW1, PPW4, the two metal plates forming the top and bottom walls of the corresponding waveguide comprise phase-shifting zones 23*a*, 23*b* that can consist of corrugations formed locally on the internal surface of the two corresponding metal plates and the width of which is equal to the transverse width D of the corresponding metal plates. In the example of FIGS. 3*a* and 3*b*, the number N of waveguides is equal to four, and the number of metal plates 20 is equal to five. Between the inputs 11, 12, 13, 14 and the outputs O1, O2, O3, O4 of the Butler matrix, a first coupling zone 22*a* is incorporated in the second metal plate common to the first waveguide PPW1 and to the second waveguide PPW2 and a second coupling zone 22*b* is incorporated in the fourth metal plate common to the third waveguide PPW3 and to the fourth waveguide PPW4. Downstream of the two coupling zones 22*a*, 22*b*, the Butler matrix comprises a crossover zone 24 consisting of two 3 dB, 90° hybrid couplers, incorporated, cascaded one behind the other, in the third metal plate common to the second and third waveguides PPW2, PPW3, and two phase-shifting zones 23*a*, 23*b* respectively formed in the top and bottom walls of the first and fourth waveguides PPW1, PPW4. Finally, downstream of the phase-shifting zones 23*a*, 23*b* and of the crossover zone 24, a third and a fourth coupling zones 23*c*, 23*d*, are respectively incorporated in the second metal plate common to the first and second waveguides PPW1, PPW2 and in the fourth metal plate common to the third and fourth waveguides PPW3, PPW4. In operation, in the crossover zone 24 between two adjacent waveguides PPW2, PPW3, the radiofrequency signals propagating in the two adjacent waveguides, cross over, then mutually swap over their propagation waveguide, which makes it possible to group together, two-by-two, signals which are propagated initially in non-adjacent waveguides to couple them together. Thus, in this example, the radiofrequency signals which are propagated initially in the waveguides PPW2 and PPW3 are swapped into the crossover zone 24 and are then propagated, downstream of the crossover zone, respectively in the waveguides PPW3 and PPW2. They can therefore then be respectively coupled to the radiofrequency signals which are propagated in the waveguides PPW4 and PPW1. For the Butler matrix to operate correctly for a number of incidences of radiofrequency waves propagated, according to a TEM mode, in the parallel plate waveguides, it is necessary for the phase-shifting, coupling and crossover zones to be compact and therefore for the surface impedances to be high. The size of the phase-shifting, coupling and crossover zones is all the smaller when the Butler matrix operates over a wider band and for higher radiofrequency wave incidences.

Figure 5:
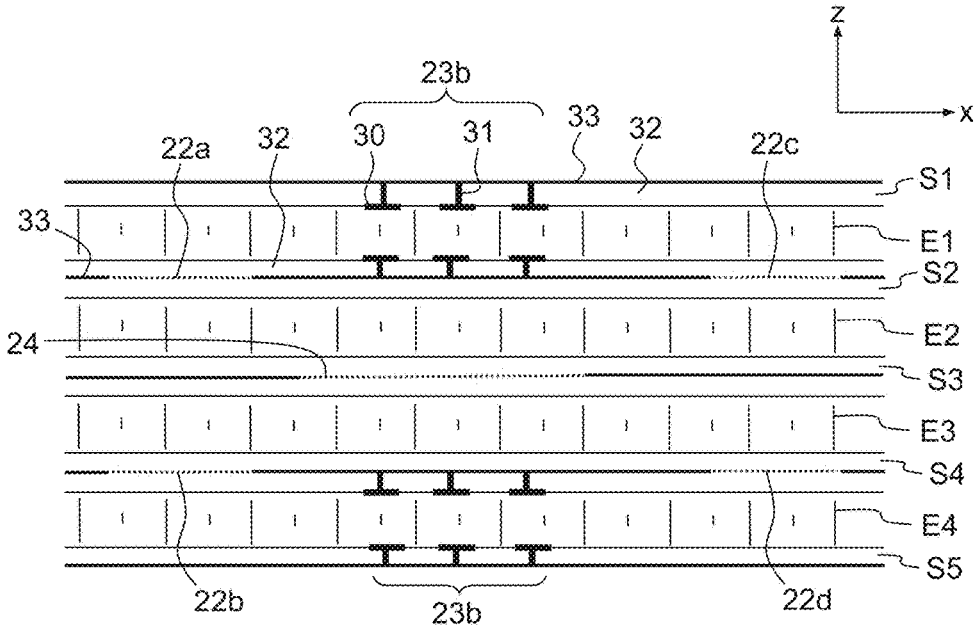
FIG. 5: a diagram in longitudinal cross section, of a second exemplary embodiment of a Butler matrix comprising a composite stacking of a number of layers of etched and metallized substrates separated by spacers, according to the invention.

Alternatively, as represented in the example of FIG. 5, the Butler matrix can be produced according to a printed circuit technology by using a composite multilayer structure comprising a stacking of several layers consisting of etched and metallized substrates S1, S2, S3, S4, S5 that can possibly be separated by spacers E1, E2, E3, E4. Each layer forms a waveguide comprising two mutually parallel metallized walls, each wall consisting of a metal coating 33 deposited on a dielectric substrate 32, the spacer situated between two metallized walls being able to consist of air or comprise a material transparent to the radiofrequency waves, such as, for example, a honeycomb material, or a quartz material, or a Kevlar material, or an expanded polymer foam. The role of a spacer is to reduce the propagation losses, but this spacer is not essential. The metal coating 33 deposited on the substrate 32 is then equivalent to a metal plate 20. The coupling 22*a*, 22*b*, 22*c*, 22*d* and crossover 24 zones between two adjacent waveguides then consist of a plurality of slits etched in the metal coating, the slits being evenly distributed throughout the coupling zone, respectively throughout the crossover zone, the length of the crossover zone 24 being equal to twice the length of a coupling zone. The phase-shifting zones consist of metasurfaces, deposited on the metal coating, which modify the propagation delay of the radiofrequency waves. According to the invention, in the phase-shifting zone 23*a*, 23*b* of a waveguide, the metasurfaces can, for example, consist of a set of metal blocks, or of metal patches 30 periodically photo-etched by photolithography on the inner face of the dielectric substrate of the two walls of the corresponding waveguide. Although this is not essential, the metal patches can for example be short-circuited by linking them to the metal coating of the wall of the corresponding waveguide, by a metallized through-hole 31 formed in the corresponding dielectric substrate. The period of distribution of the metal patches, equal to the distance between two adjacent metal patches, is less than the propagation wavelength of the radiofrequency waves in the waveguide with parallel metal walls.

Figure 6:
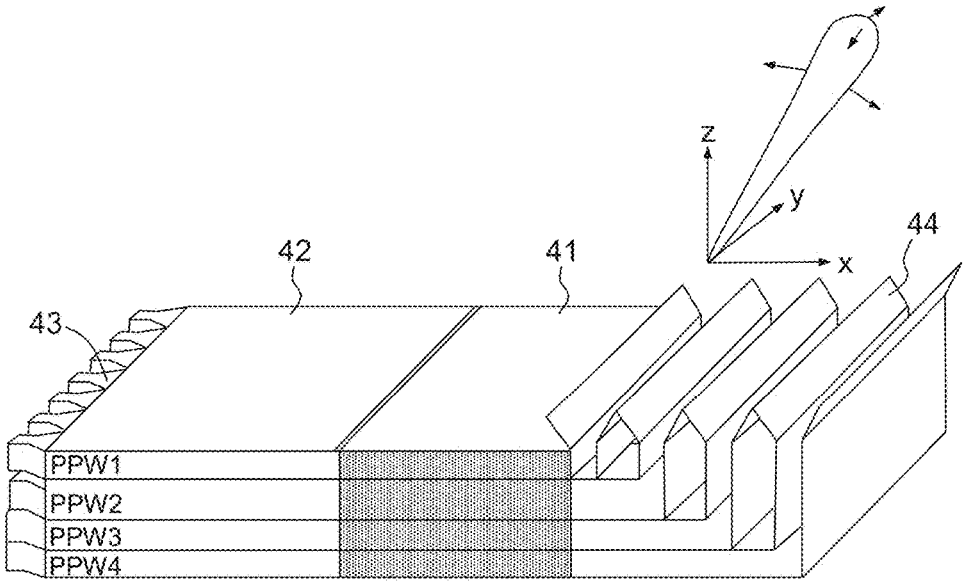
FIG. 6: a perspective diagram, of a first exemplary two-dimensional beam-former, connected to linear apertures, and comprising a Butler matrix, according to the invention.
Figure 7:
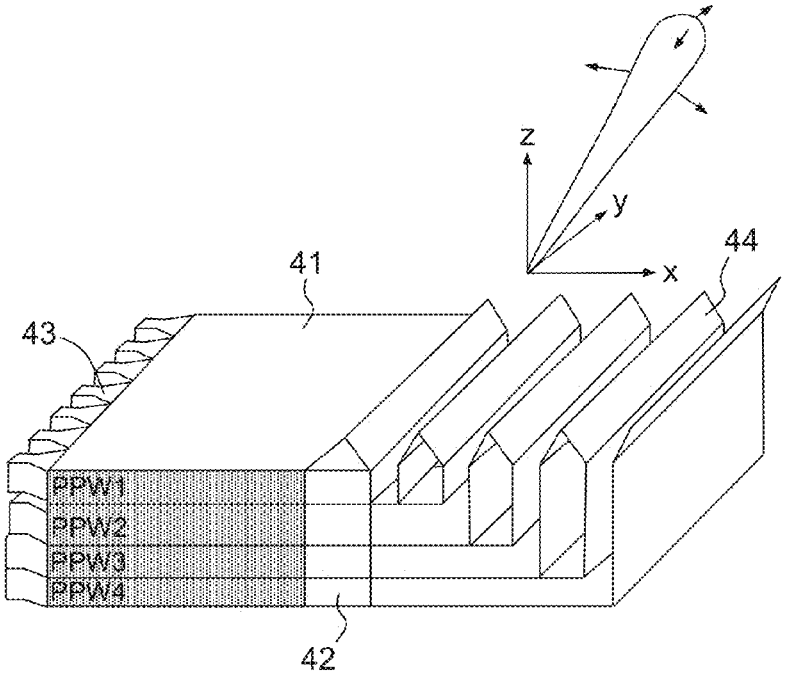
FIG. 7: a perspective diagram of a second exemplary two-dimensional beam-former, connected to linear apertures, and comprising a Butler matrix, according to the invention.
Figure 8A:
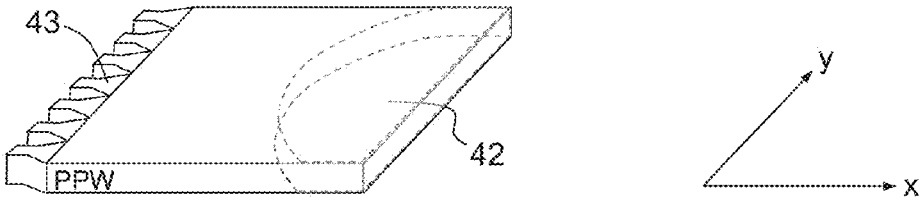
FIG. 8*a*: a perspective diagram of an exemplary dielectric lens incorporated in a parallel plate waveguide, according to the invention.
Figure 8B:
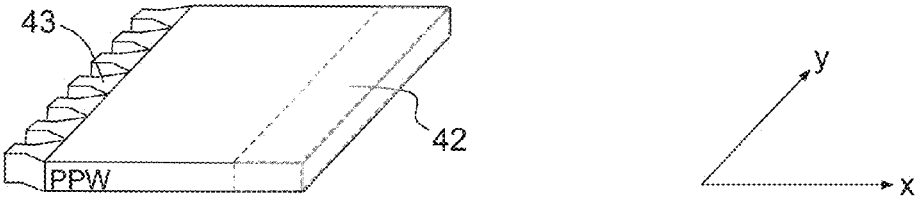
FIG. 8*b*: a perspective diagram of an exemplary lens of constant thickness and with graded index incorporated in a parallel plate waveguide, according to the invention.

The Butler matrix according to the invention constitutes a one-dimensional beam-former when it is used alone. According to the invention, the two-dimensional planar beam-former comprises a Butler matrix 41 comprising N parallel plate waveguides PPW, stacked one on top of the other, in which N is an integer number greater than three and chosen from the powers of two, for example, 4, 8, 16, 32, . . . , and further comprises an optical device of optical lens or reflector type. In FIGS. 6 and 7, the number N of waveguides PPW1, PPW2, PPW3, PPW4 is equal to 4. The structure of the Butler matrix is identical to that represented in FIGS. 3*a* and 3*b*. Furthermore, the beam-former comprises N optical lenses 42 respectively incorporated in the N waveguides delimited by the N+1 parallel metal plates. In FIG. 6, the optical lenses 42 are formed in the waveguides PPW, at the input of the Butler matrix 41, between input feeder horns 43 of each waveguide and the Butler matrix 41, whereas, in FIG. 7, the optical lenses 42 are formed in the waveguides PPW at the output of the Butler matrix 41, between the Butler matrix and output horns 44. Each optical lens 42 can for example be a dielectric lens with a dielectric permittivity different from that of the propagation medium of the parallel plate waveguides PPW1, PPW2, PPW3, PPW4 (which is equal to 1 if the waveguides PPW1, . . . , PPW4 are filled with air or equal to the permittivity of the substrate 32 in the case where the waveguides consist of a stacking of layers of metallized and etched substrates). Each optical lens 42 incorporated in a parallel plate waveguide can comprise parabolic edges as represented in the waveguide PPW of FIG. 8*a*, or be a lens of variable thickness, or, to avoid discontinuities of form, be a lens with straight edges, of constant thickness and with graded refractive index as represented in the waveguide PPW of FIG. 8*b*, or any other type of optical lens with variable refractive index making it possible to phase-shift the radiofrequency waves according to a predefined phase law.

The planar beam-former that is thus produced makes it possible, with the Butler matrix 41, to synthesize beams in the plane XOZ at right angles to the parallel plates and makes it possible, with the optical lens 42, to synthesize beams in the plane XOY parallel to the parallel plates without any discontinuity of propagation in the parallel plate waveguides and without using any interconnection, or any link cable.

To obtain a planar antenna, M feeder horns 43 aligned alongside one another are connected at the input of each waveguide PPW, where M is greater than two, and at the output of the beam-former, each waveguide PPW can be linked to a number of output radiating elements or to a single longitudinal feeder horn 44 coupled to a linear aperture. In FIGS. 6, 7, 8*a* and 8*b*, the number M of feeder horns 43 is equal to 7 per waveguide, i.e. M.N input horns in total, equal to 28 for the four waveguides PPW. In FIGS. 6 and 7, a single longitudinal feeder horn 44 is used at the output of each waveguide PPW. Each linear aperture, coupled to the output longitudinal feeder horn 44, extends transversely over the entire width D of the corresponding waveguide. In FIGS. 6 and 7, each linear aperture is oriented to radiate in a direction Z at right angles to the plane XOY of the parallel plates but this is not essential, the linear apertures could also be in the extension of the parallel plates. It should be noted that, in FIGS. 6 and 7, the plane of radiation of the longitudinal feeder horns is not in the extension of the parallel plates, but is folded back relative to the parallel plates. Obviously, this is not essential. It is also possible to arrange the feeder horns in the extension of the parallel plates, but in this case, it may be necessary to add a transition between each horn and the corresponding waveguide when the width of the horns is greater than the thickness of the waveguides. A longitudinal horn offers the advantage of radiating the energy over the entire aperture width of the parallel plate waveguide, which makes it possible to produce an antenna with great operating bandwidth and with a great capacity for misalignment of the beam formed and makes it possible to dispense with the array lobes.

The dimensions of the beam-former including optical lenses are greatly constrained by the focal distance between each optical lens 42 and the input feeder horns 43. The greater the focal distance, the better the quality of the misaligned beams. When the optical lenses are formed at the output of the Butler matrix as represented in FIG. 7, the focal distance required between each optical lens and the feeder horns is advantageously used by the Butler matrix, which makes it possible to reduce the dimensions of the beam-former which is then more compact. In this embodiment, the radiofrequency waves which are propagated in the Butler matrix are no longer planar but cylindrical.

Figure 9:
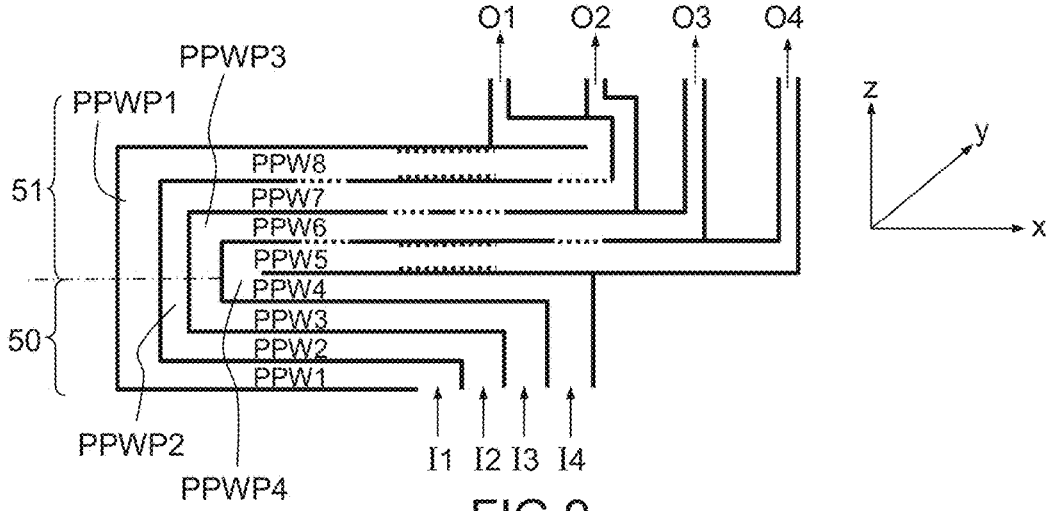
FIG. 9: a diagram, in longitudinal cross section, of a third exemplary two-dimensional beam-former comprising a Butler matrix, according to the invention.
Figure 10A:
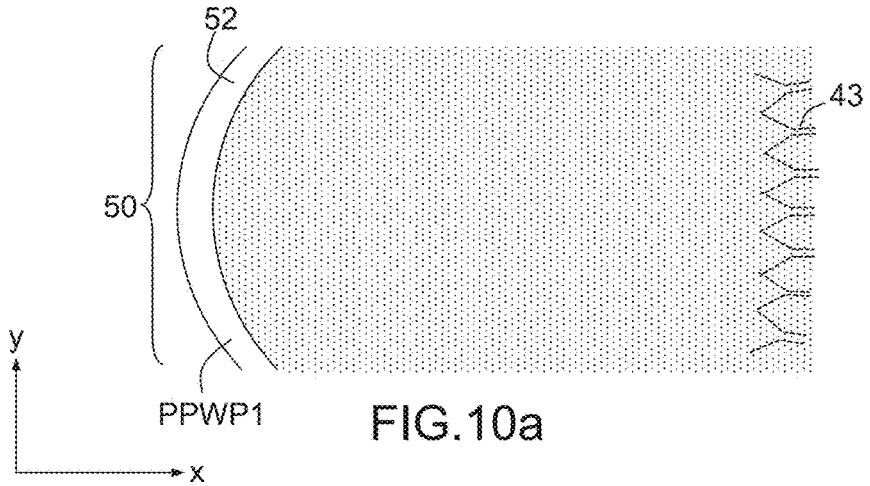
FIGS. 10*a* and 10*b*: a diagram, in plan view, of two stages, respectively lower and upper, of a planar antenna according to the embodiment of FIG. 9.
Figure 10B:
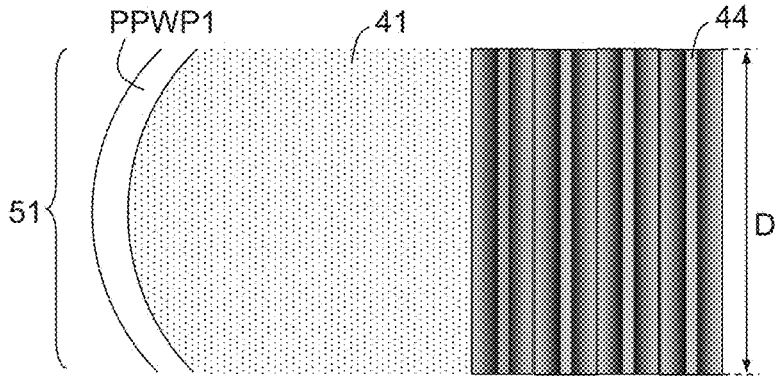

FIG. 9 illustrates another embodiment of a two-dimensional planar beam-former that exhibits no discontinuity of propagation. In this embodiment, the planar beam-former comprises 2 N+1 parallel plates 20 forming the respective walls of 2 N parallel plate waveguides distributed over two stages, respectively lower 50 and upper 51. Each stage comprises N waveguides in PPW technology, stacked one on top of the other, where N is greater than three. Each parallel plate waveguide PPW1, PPW2, PPW3, PPW4 of the lower stage is respectively connected in series to a parallel plate waveguide PPW8, PPW7, PPW6, PPW5 of the upper stage via a respective intermediate parallel plate waveguide PPWP1, PPWP2, PPWP3, PPWP4, arranged orthogonally to the plane XOY of the two stages of the beam-former. The parallel metal plates forming the walls of each intermediate waveguide then form a reflector incorporated in the beam-former, as in a pillbox-type beam-former. The parallel metal plates forming the walls of the intermediate waveguides can comprise a profile of chosen form, which can for example be of straight form as illustrated in FIG. 9 or of curved form, for example of parabolic form, as illustrated in FIGS. 10*a* and 10*b*, which represent two stages, lower and upper, of a planar antenna comprising such a beam-former. At the output of the reflector, the N waveguides PPW8, PPW7, PPW6, PPW5 of the upper stage are coupled together by a Butler matrix according to the invention and as described in association with FIGS. 3*a* and 3*b*.

To produce a planar antenna, it is then sufficient to equip each waveguide PPWP1, PPWP2, PPWP3, PPWP4 of the lower stage of the beam-former with a number of feeder horns 43 and, at the output of the Butler matrix 41, to couple each waveguide PPW8, PPW7, PPW6, PPW5 of the upper stage to an output longitudinal horn 44 coupled to a linear aperture extending transversely over the entire width D of the corresponding metal plate waveguide, as represented in FIGS. 10*a* and 10*b*.

Figure 11:
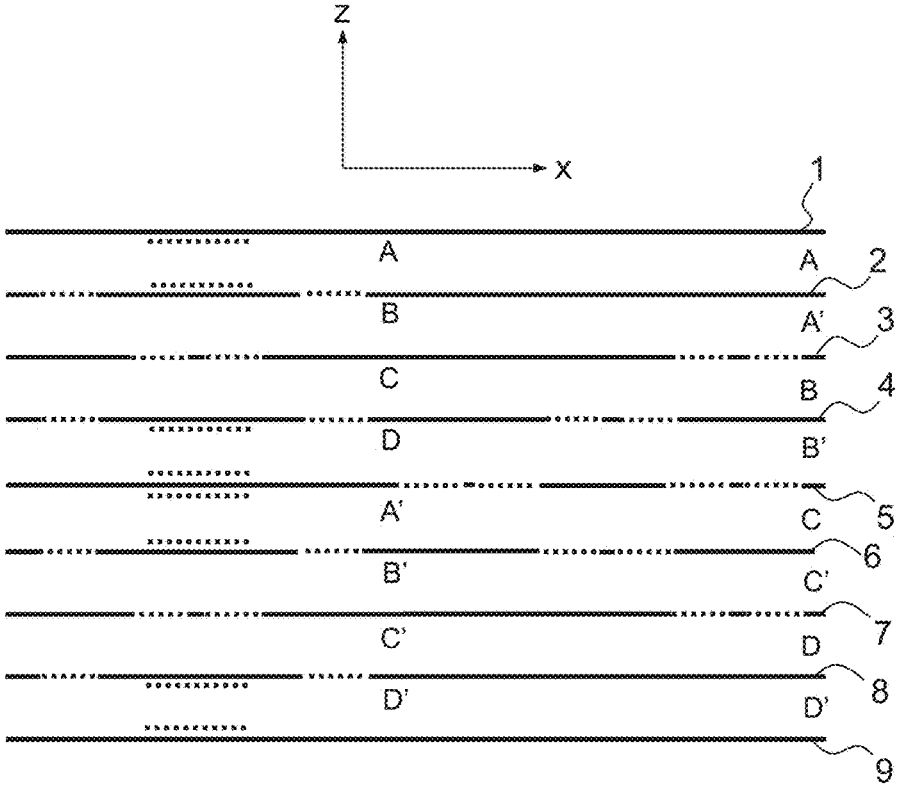
FIG. 11: a diagram in longitudinal cross section of an exemplary bi-polarization Butler matrix, according to the invention.

For operation in double polarization mode, for example circular, the invention consists in using two identical Butler matrices, respectively dedicated to each polarization, and stacked one on top of the other as represented in FIG. 11 where each Butler matrix comprises four waveguides A, B, C, D and A', B', C', D', in parallel plate waveguide PPW technology. Since each Butler matrix is dedicated to one of the two polarizations, at the output of the beam-former, the waveguides PPW operating in a same polarization are adjacent to one another. Now, to produce an antenna with double circular polarization, it is necessary to feed output radiating elements with double circular polarization via orthomodal transducers OMT. It is therefore necessary, at the output of the Butler matrices, to group together, two-by-two, waveguides of different polarization. For that, at the output of the two Butler matrices, the invention further consists in successively crossing over adjacent waveguides chosen to group together, two-by-two, the waveguides of different polarizations. The crossovers are produced by metasurfaces incorporated in the metal plates common to two adjacent waveguides to be crossed over, as explained in relation to FIG. 3*b*. Thus, in the example of FIG. 11, a first crossover is produced between the waveguides D and A' by a metasurface incorporated in the fifth metal plate 5. Then, two successive crossovers are respectively produced between the waveguides D and C and between the waveguides B and C by corresponding metasurfaces incorporated in the fourth and third metal plates 4, 3. Symmetrically, two successive crossovers are respectively produced between the waveguides A' and B' and B' and C' by corresponding metasurfaces incorporated in the plates 6, 7. The various crossovers produced make it possible, at the output of the two Butler matrices, to group together the waveguides A and A', the waveguides B and B', the waveguides C and C' and the waveguides D and D'. The number of waveguides of each Butler matrix is not limited to four but must be equal to a power of two.

Although the invention has been described in relation to particular embodiments, it is clear that it is in no way limited thereto and that it includes all the technical equivalents of the means described as well as the combinations thereof if the latter fall within the scope of the invention.

The invention claimed is:

1. A compact Butler matrix comprising N waveguides, wherein N is an integer number greater than three and chosen from the powers of two, couplers intended to couple two adjacent waveguides, phase-shifters and at least one crossover device suitable for crossing over two adjacent waveguides, the crossover device comprising two couplers connected in series, the Butler matrix consisting of a planar multilayer structure comprising N+1 mutually parallel metal plates, stacked one on top of the other, and evenly spaced apart from one another, each space between two consecutive metal plates forming a parallel plate waveguide having two opposing walls, respectively top and bottom, consisting of the two consecutive metal plates, two adjacent metal plate waveguides comprising a common wall consisting of one of the metal plates, and the couplers, the phase-shifters and the crossover device consist of metasurfaces locally incorporated in the respective walls of the waveguides to be coupled, to be crossed over and to be phase-shifted.

2. The Butler matrix according to claim 1, wherein the metasurfaces forming each coupler and the crossover device between two adjacent waveguides consist of a metallized support provided with a plurality of through-holes evenly distributed in a coupling zone, respectively a crossover zone, of the wall common to the two corresponding adjacent waveguides, the crossover zone consisting of two coupling zones arranged cascaded one behind the other.

3. The Butler matrix according to claim 2, wherein the metasurfaces forming each phase-shifter incorporated in a waveguide consist of corrugations formed in a phase-shifting zone, on the two opposing walls of the corresponding waveguide.

4. The Butler matrix according to claim 1, wherein each metal plate consists of a metal coating deposited on a dielectric substrate and wherein each coupler and the crossover device between two adjacent waveguides consists of a plurality of slits etched in the metal coating, the slits being evenly distributed throughout the coupling zone, respectively throughout the crossover zone, the crossover zone consisting of two coupling zones arranged cascaded one behind the other.

5. The Butler matrix according to claim 4, wherein each phase-shifter consists of a set of metal patches periodically photo-etched on the dielectric substrate of the two walls of a waveguide to be phase-shifted.

6. A planar beam-former comprising at least one Butler matrix according to claim 1.

7. The planar beam-former according to claim 6, comprising two different Butler matrices stacked one on top of the other and respectively dedicated to two different mutually orthogonal polarizations.

8. The planar beam-former according to claim 6, further comprising N optical lenses respectively incorporated, at the output of the Butler matrix, in the N waveguides delimited by the N+1 parallel metal plates.

9. The planar beam-former according to claim 6, further comprising N optical lenses respectively incorporated, at the input of the Butler matrix, in the N waveguides delimited by the N+1 metal plates.

10. The planar beam-former according to claim 8, wherein each optical lens is a lens of constant thickness and with graded index.

11. The planar beam-former according to claim 9, wherein each optical lens is a lens of constant thickness and with graded index.

12. The planar beam-former according to claim 6, comprising two stacked stages, respectively lower and upper, each stage comprising an identical number of parallel plate waveguides, the Butler matrix being situated at the upper stage, each parallel plate waveguide of the lower stage being connected in series to a parallel plate waveguide of the upper stage by a respective intermediate parallel plate waveguide arranged orthogonally to the plane XOY of the two lower and upper stages, each intermediate waveguide forming a reflector incorporated in the beam-former.

13. The planar antenna comprising at least one Butler matrix according to claim 1, further comprising M feeder horns connected at the input of each parallel metal plate waveguide, i.e. M.N feeder horns for the N parallel metal plate waveguides, wherein M is greater than 2, and N output feeder horns respectively connected to the N parallel metal plate waveguides.

14. The planar antenna according to claim 12, wherein each output feeder horn is a longitudinal horn coupled to a linear aperture extending transversely over an entire width of the corresponding parallel plate waveguide.

15. The planar antenna according to claim 13, wherein the linear apertures are oriented in a direction at right angles to the plane of the parallel plates of the corresponding parallel plate waveguide.

* * * * *